US008297015B2

(12) United States Patent
Martin

(10) Patent No.: US 8,297,015 B2
(45) Date of Patent: Oct. 30, 2012

(54) BUILT-IN INTERIOR WALL CAVITY DRYING AND FILTRATION SYSTEM

(76) Inventor: William F. Martin, Boca Raton, FL (US)

( * ) Notice: Subject to any disclaimer, the term of this patent is extended or adjusted under 35 U.S.C. 154(b) by 111 days.

(21) Appl. No.: 13/065,044

(22) Filed: Mar. 11, 2011

(65) Prior Publication Data

US 2011/0219714 A1 Sep. 15, 2011

Related U.S. Application Data

(60) Provisional application No. 61/340,129, filed on Mar. 13, 2010.

(51) Int. Cl.
*E04B 1/70* (2006.01)

(52) U.S. Cl. ..... 52/302.1; 52/302.3

(58) Field of Classification Search ..... 52/302.1, 52/302.3, 606; 34/104, 443
See application file for complete search history.

(56) References Cited

U.S. PATENT DOCUMENTS 5,155,924 A * 10/1992 Smith ..... 34/443
5,555,643 A * 9/1996 Guasch ..... 34/443
5,893,216 A * 4/1999 Smith et al. ..... 34/103
7,461,494 B2 * 12/2008 Frezza ..... 52/846
7,882,668 B2 * 2/2011 Pedersen ..... 52/302.3
8,056,252 B2 * 11/2011 Fernandes ..... 34/60
8,205,398 B2 * 6/2012 Chich et al. ..... 52/95

* cited by examiner

*Primary Examiner* — Jeanette E Chapman
*Assistant Examiner* — Daniel Kenny
(74) *Attorney, Agent, or Firm* — Robert M. Downey, P.A.

(57) ABSTRACT

A permanently installed wall cavity and filtration system provides molded base dry block members that install along the base of a wall between the floor and a bottom edge of drywall, gypsum board or other conventional interior wall construction material. The base block members have connection ports at opposite ends that communicate with an interior airflow channel on an inner facing side of the block members. The air flow channel communicates with the wall interior. A forced flow of dry air is directed through one of the ports, thereby allowing the forced dry air to circulate into the interior wall cavities in order to remove moisture and dampness. The damp, contaminated air can also be pulled out through any one of the connection ports by vacuum force, and filtered to avoid contamination of the surrounding interior living environment.

9 Claims, 8 Drawing Sheets

BUILT-IN INTERIOR WALL CAVITY DRYING AND FILTRATION SYSTEM

This non-provisional application is based on provisional patent application Ser. No. 61/340,129 filed on Mar. 13, 2010.

BACKGROUND OF THE INVENTION

1. Field of the Invention

The present invention relates to an interior wall drying system and, more particularly, to base board or base block members that install along the base of a wall and allow for dry air to be forced into the interior wall cavities and/or damp air to be pulled out from the interior wall cavities in order to remove moisture and dampness.

2. Discussion of the Related Art

Interior wall construction in a home or building typically consists of an interior framing system, such as metal studs, and drywall or gypsum board panels that are attached to the studs. In most instances, the drywall or gypsum board extends all the way down to the floor. In the event of a flood, the bottom edge of the drywall or gypsum board will usually make direct contact with the flooding water or other liquid. While most building floods are only 1-2" deep, the drywall or gypsum board will cause the water to wick up the wall to a height of 3 feet or more. This moisture stays within the interior wall cavity for an extended period of time. Eventually, microbial growth, such as fungal growth, will result in permanent interior wall damage. Fungal growth can produce a foul odor and may eventually present a serious health hazard if not removed properly.

In the event of a flood, hazardous fungal growth behind the interior walls could be avoided by directing a forced flow of dry air through the interior wall cavities. Additionally, the damp air within interior wall cavities can be removed by pulling the damp air out by vacuum force. However, once the bottom of the gypsum board or drywall becomes wet, it must be cut out and replaced. This involves an expensive repair process wherein it is necessary to remove baseboard, mold and other trimming in order to cut out the damaged gypsum board or drywall. Dry air can then be directed into the interior wall cavities. Thereafter, once the interior wall cavities are dry, new gypsum board or drywall can be installed and patched. It is then necessary to repaint the wall surfaces and replace the baseboard.

Water damage to the bottom of gypsum board or drywall could be avoided by maintaining a gap between the bottom edge of the gypsum board and the floor surface and then providing a decorative baseboard or block structure that allows for connection of a forced dry air supply in order to pump dry air into the interior wall cavity and/or pull damp air from the interior wall cavity. Accordingly, there remains a need for a permanently installed interior wall drying and filtration system that attaches between the bottom edge of gypsum board or drywall and the underlying floor surface about the perimeter of interior walls, and wherein the system allows for directing a forced flow of dry air into interior wall cavities and/or pulling moist or damp air out from the interior wall cavities with filtration to prevent contamination of the interior living environment.

SUMMARY OF THE INVENTION

The present invention is directed towards a permanently installed wall cavity and filtration system that includes molded base dry block members that are installed along the base of a wall between the floor and the bottom edge of drywall, gypsum board or other conventional interior wall construction material. The base block members have connection ports at opposite ends that communicate with an interior airflow channel on the inner facing side of the block members. The air flow channel communicates with the interior wall cavity. A forced flow of dry air is directed through one of the ports, thereby allowing the forced dry air to circulate into the interior wall cavities in order to remove moisture and dampness. The damp, contaminated air can also be pulled out through any one of the connection ports by vacuum force, and filtered to avoid contamination of the surrounding interior living environment.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
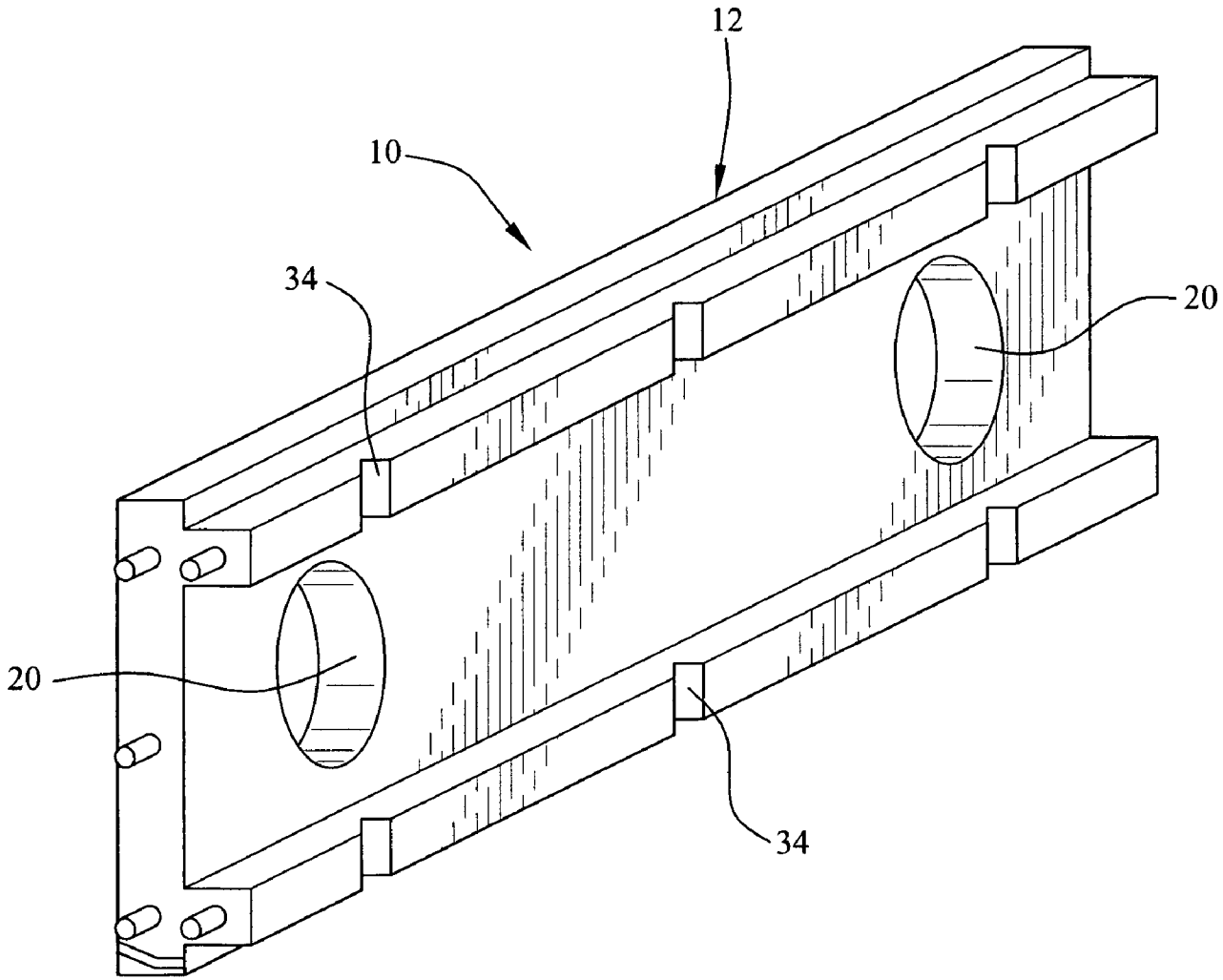
FIG. 1 is an inside perspective view showing a base dry block member with an interior airflow channel and open port in accordance with one preferred embodiment of the present invention.
Figure 2:
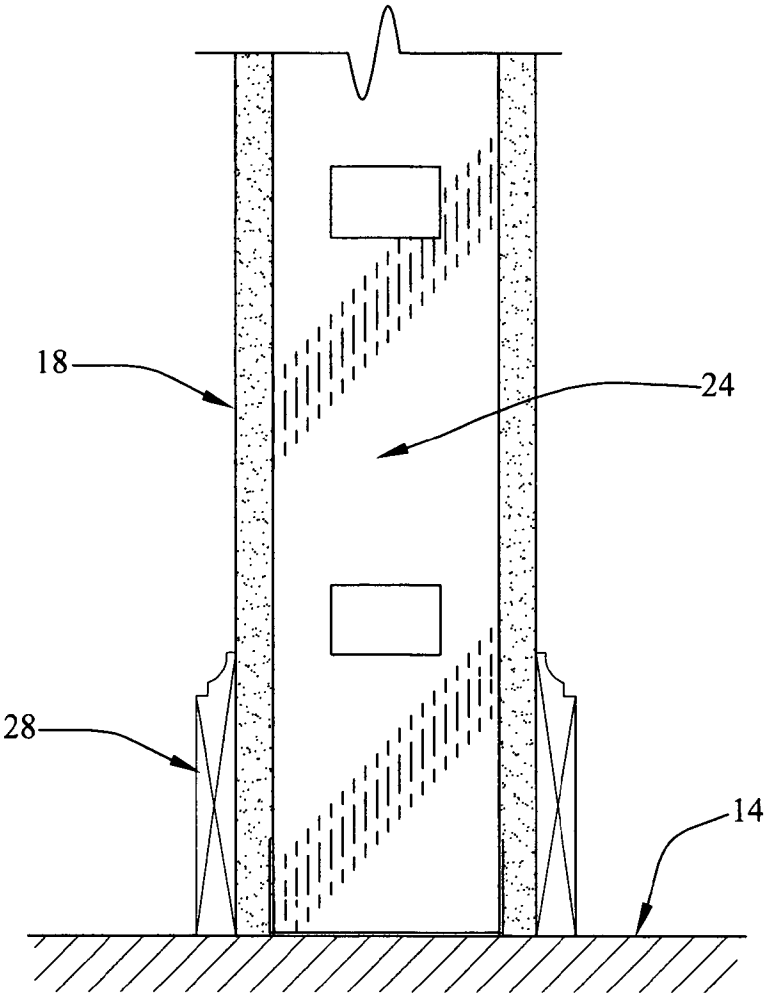
FIG. 2 (PRIOR ART)
FIG. 2 is a side elevational view, in cross-section, showing the typical construction of an interior wall frame structure, gypsum board extending down to the floor, and base trim extending down to the floor.
Figure 3:
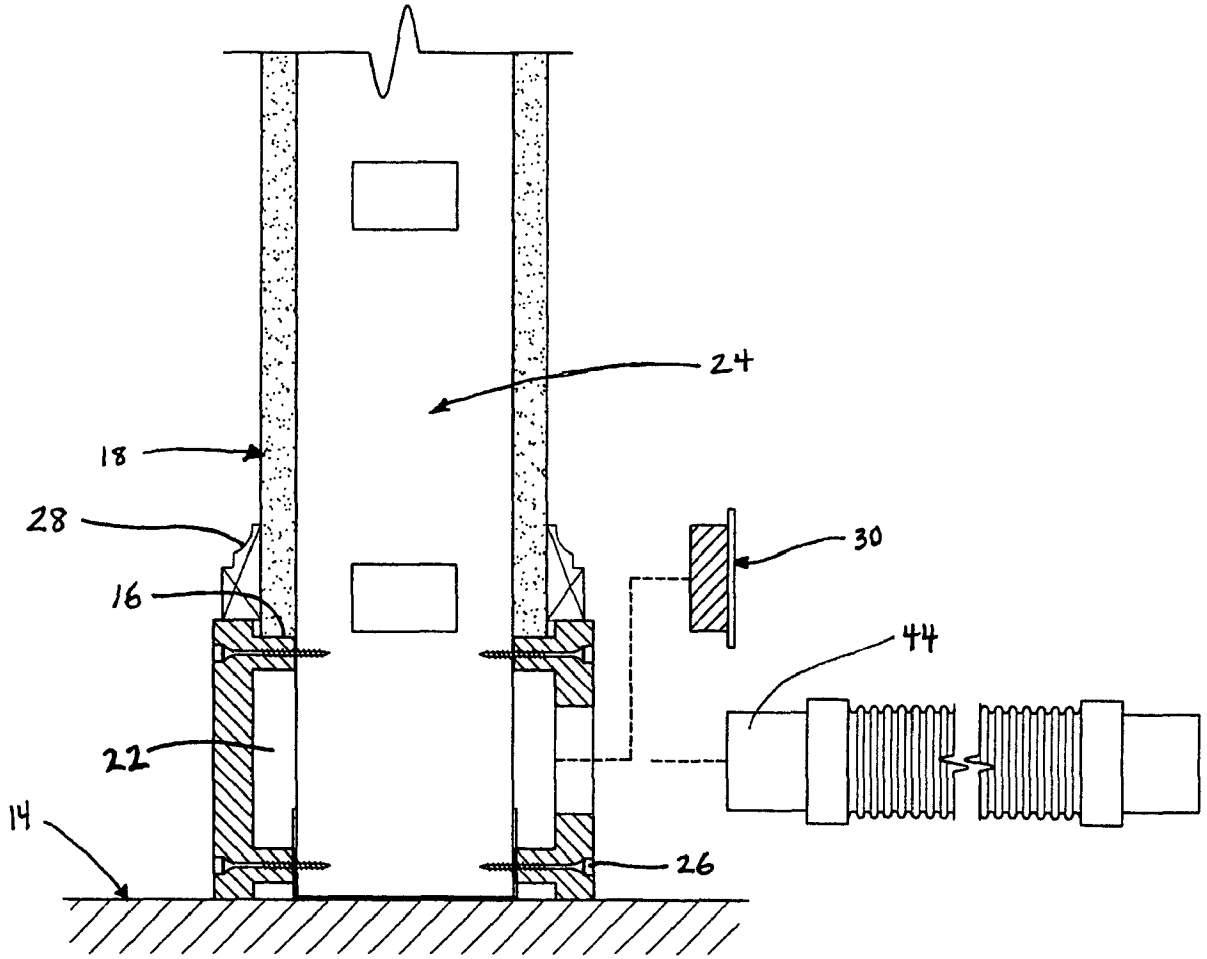
FIG. 3 is a side elevational view, in cross section, showing the base dry block members installed on opposing sides of the interior wall frame structure between the bottom edge of a gypsum board and the underlying floor surface, with an interior airflow channel of the base block member communicating with the interior wall cavities, a connection port in communication with the interior airflow channel for forced supply of dry air and/or a filtered vacuum source, and a flexible hose sized for secure attachment with the connection port.
Figure 4:
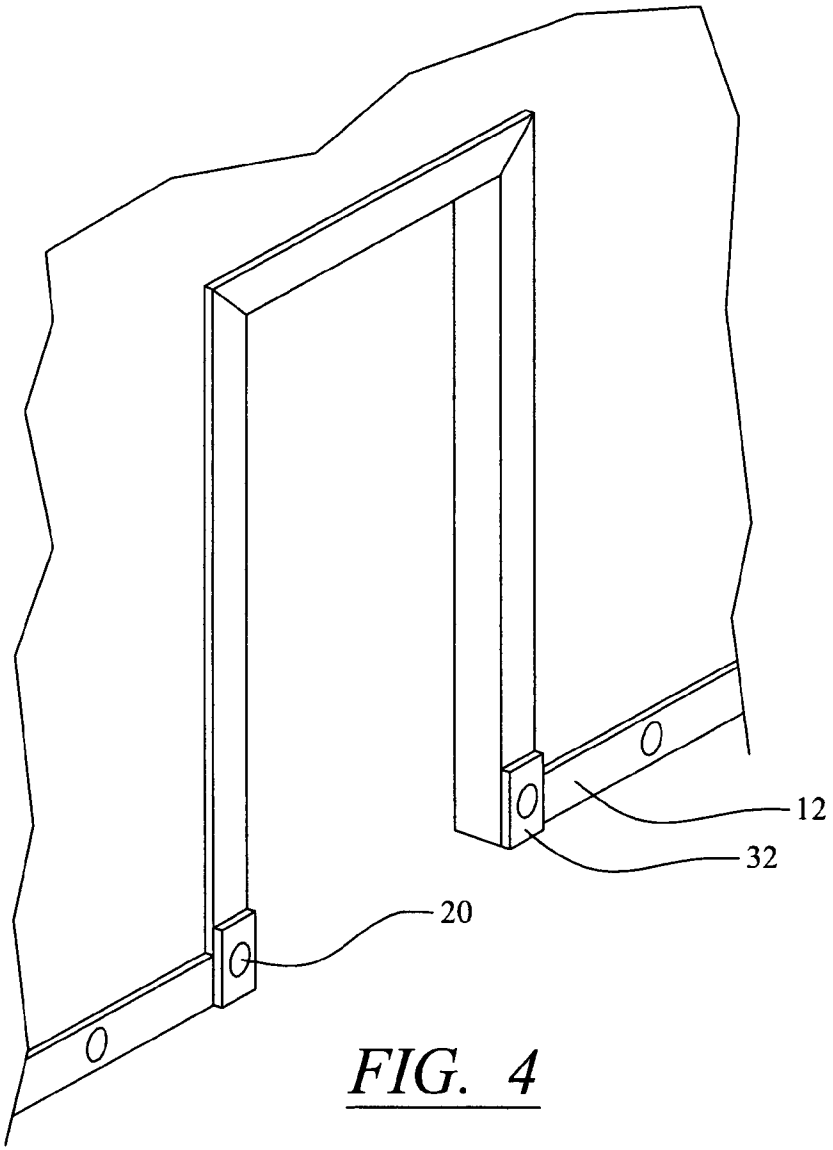
FIG. 4 is a perspective view showing a door frame dry block member having connection ports installed at the bases of both sides of a door frame and base dry block members having connection ports installed throughout the base of the walls.

Referring to the several views of the drawings, the built-in interior wall cavity drying and filtration system is shown in accordance with a preferred embodiment and is generally indicated as 10.

Referring initially to FIGS. 1-4, the built-in interior wall cavity drying and filtration system 10 provides molded baseboard or base dry block members 12 that are installed along the bottom of the walls on the interior of a building structure (e.g., home, office, etc.) between the floor surface 14 and a bottom edge 16 of gypsum board 18, drywall, or other conventional interior wall construction materials. Base dry block members 12 include connection ports 20 at opposite ends communicating with an interior airflow channel 22 formed along an inner facing side of the base dry block members 12. The airflow channels 22 openly communicate with the interior wall cavities between the wall studs 24 and opposing wall surfaces. A fastening mechanism, such as screws 26, is used to secure the base dry block members 12 to the wall studs 24.

Base dry block members 12 are composed of a material suitable to prevent capillary action, i.e. wicking, from occurring. Additionally, the composition material should have high dimensional stability such that material swelling does not occur when exposed to varying ambient air temperatures and/or varying moisture content conditions.

A dry air blower or air pump 40 and/or suction device 42 connects to any of the connection ports 20 with the use of a flexible hose and fitting 44 that inserts within the connection port 20 in the base dry block members 12. Dry air can then be forced into the airflow channels 22, thereby openly communicating with the interior wall cavity in order to eliminate moisture and dampness. The moist air within the interior wall cavities can also be pulled out by way of the airflow channels 22, using suction. In this instance, where contaminated air is being removed from the interior wall cavities, a filtration system 46, such as a hepa filter, is used in order to avoid contamination of the air space in the indoor living environment. Alternatively, the contaminated air may be disposed outdoors via a flexible hose in connection with the fitting 44 inserted within the connection port 20.

Figure 5:
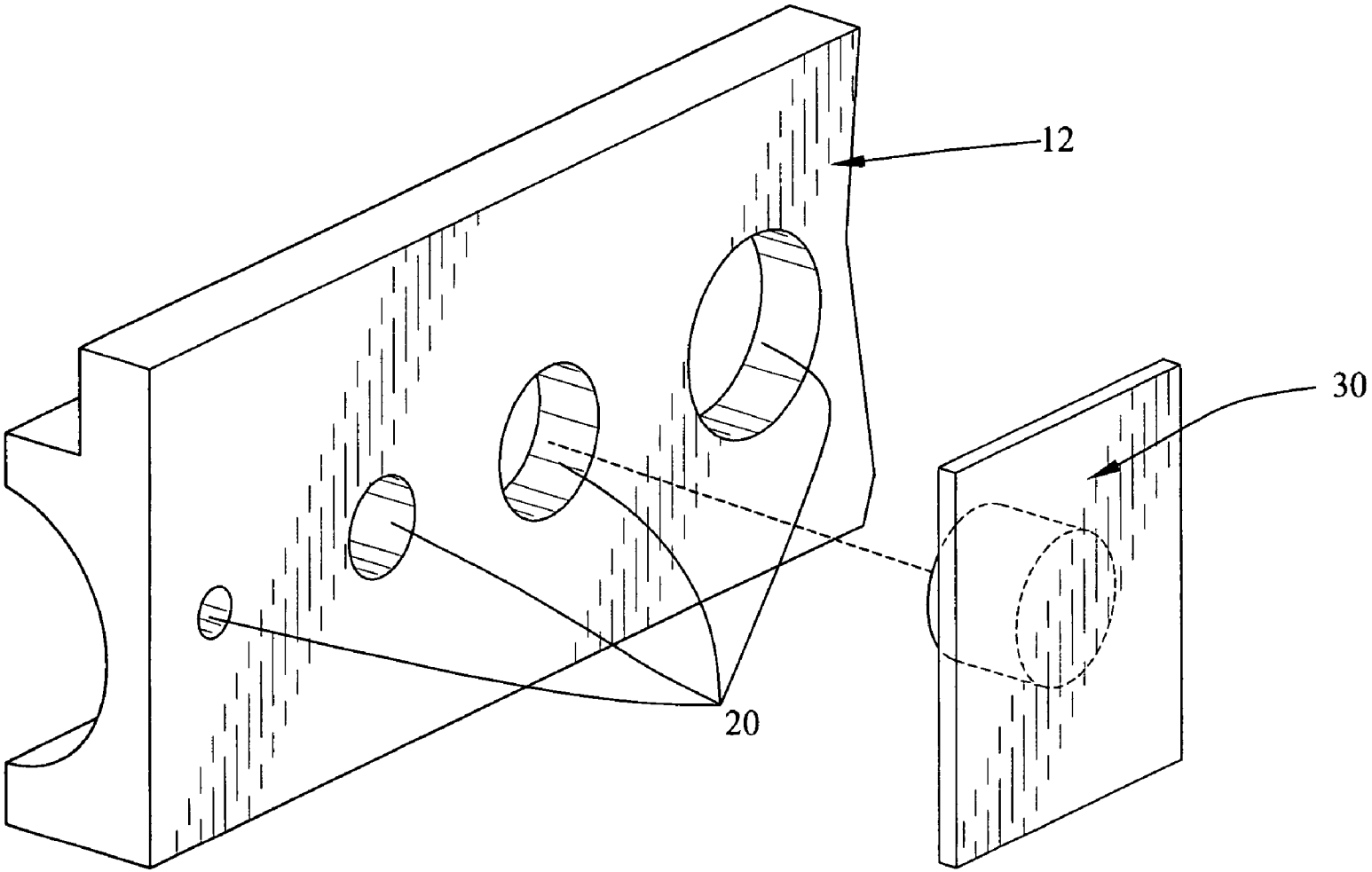
FIG. 5 is an isolated exploded view showing the exterior surface of a base dry block member, multiple embodiments of the connection ports, and a cap sized to fit securely within a connection port.

For aesthetic purposes, base trim 28 is securely fitted to the top surface of the base dry block members 12 and the exterior surface of the gypsum board 18. Additionally, as seen in FIG. 5, decorative caps 30 are sized to securely plug the connection ports 20 when the drying and filtration system 10 is not in use or for purposes of directing airflow within the airflow channel 22.

Figure 7:
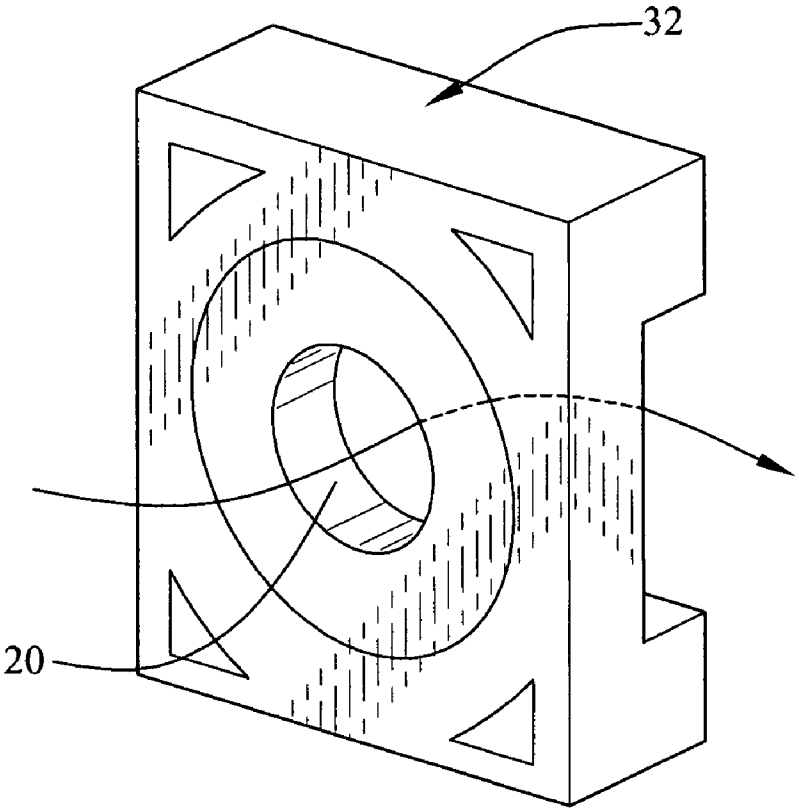
FIG. 7 is an outside perspective view showing the exterior surface of a base dry door frame block, with a forced supply of dry air being directed into the airflow channel.
Figure 6:
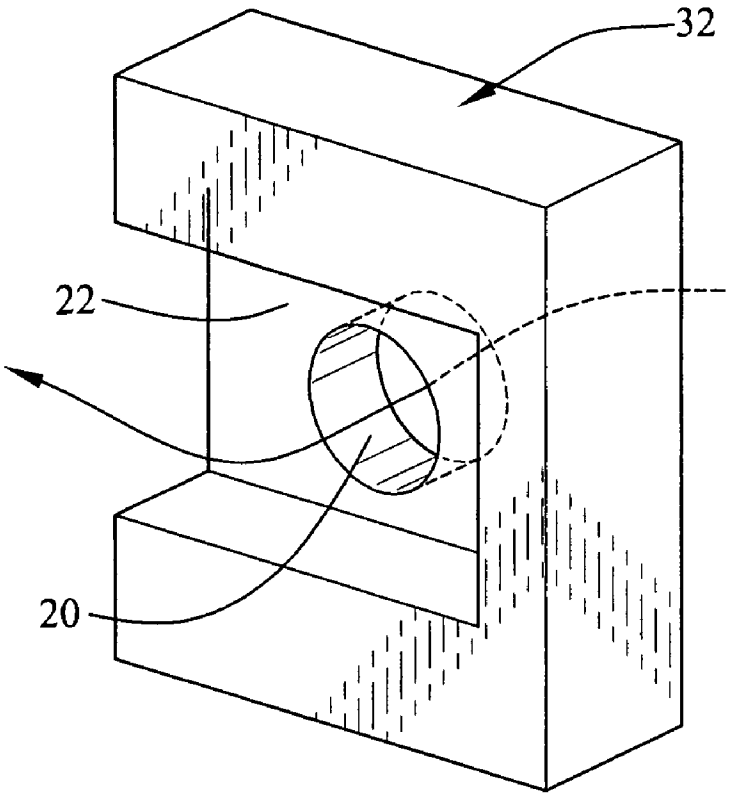
FIG. 6 is an inside perspective view showing the interior surface of a base dry door frame block, with a forced supply of dry air being directed into the airflow channel.

Referring to FIGS. 6 and 7, the built-in interior wall cavity drying and filtration system 10 further provides door frame dry block members 32 for installation at the bases of a door frame. Door frame dry block members 32 provide a connection port 20 in open communication with the interior airflow channel 22 formed along the inner side of the base dry block members 12 and door frame dry block members 32. In operation, dry air is forced into the airflow channel 22 via a dry air blower or air pump 40 in connection with the connection port 20 on the door frame dry block member 32 or, alternatively, via a suction device 42 in connection with a separate connection port 20.

Figure 8:
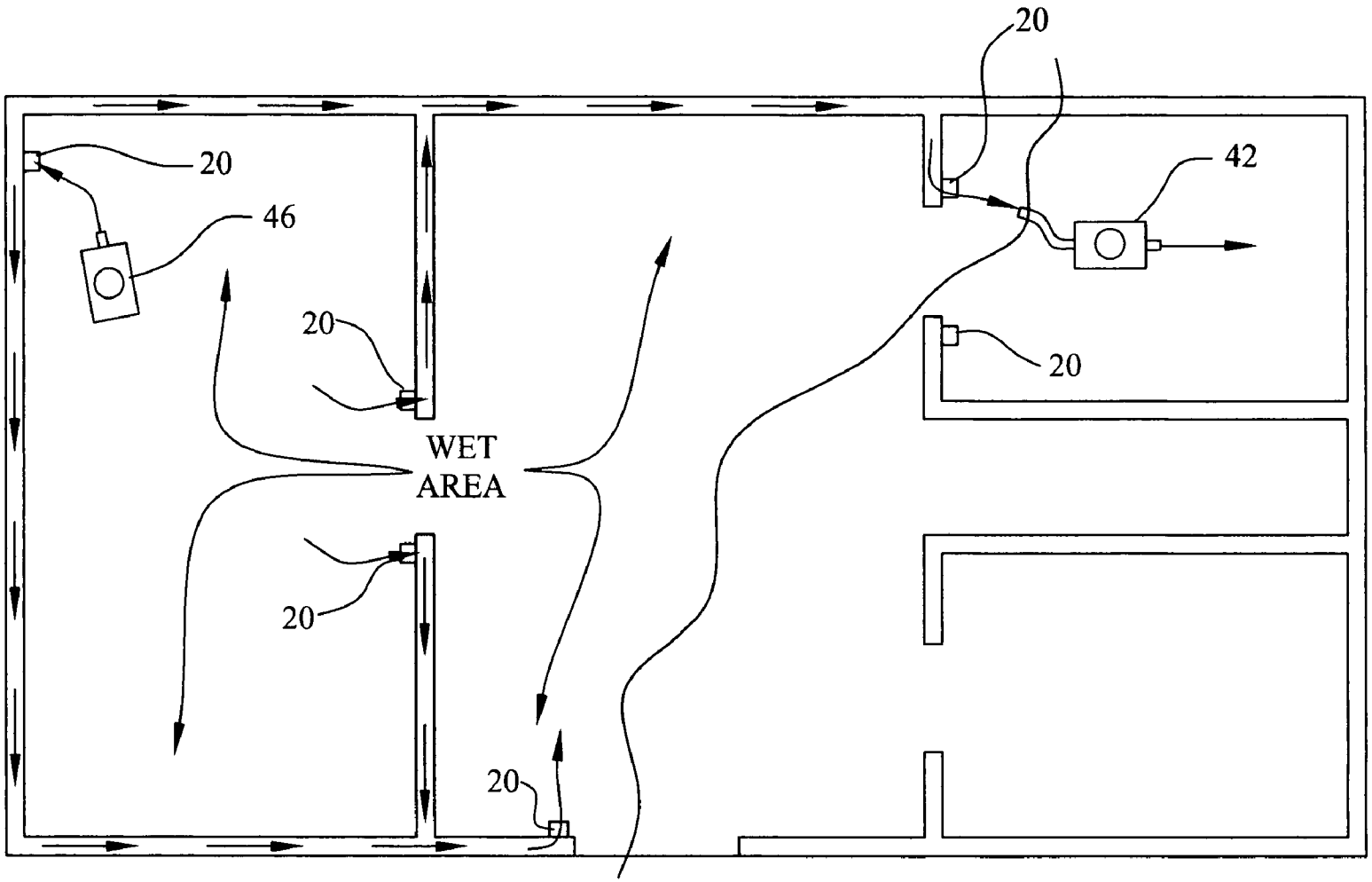
FIG. 8 is a top plan view of an interior room of a building structure showing the base dry block members of the built-in interior wall cavity drying and filtration system installed throughout the perimeter of the base of the walls, with a supply of dehumidified air being directed into the airflow channel at a connection port and a filtered suction device pulling the supply of dry air outwards from the interior wall cavity at a separate connection port in accordance with one preferred embodiment of the invention.

FIG. 8 illustrates the perimeter of a building interior installed with the built-in interior wall cavity drying and filtration system 10, wherein moisture laden air is being pulled through the airflow channel 22 by a suction device 42. In order to maximize the effectiveness of moisture and dampness removal, a dehumidifier 46 in connection with a connection port 20 may be used to prevent outside moisture from entering the wall cavities as the suction device 42 removes the moisture laden air.

Figure 9:
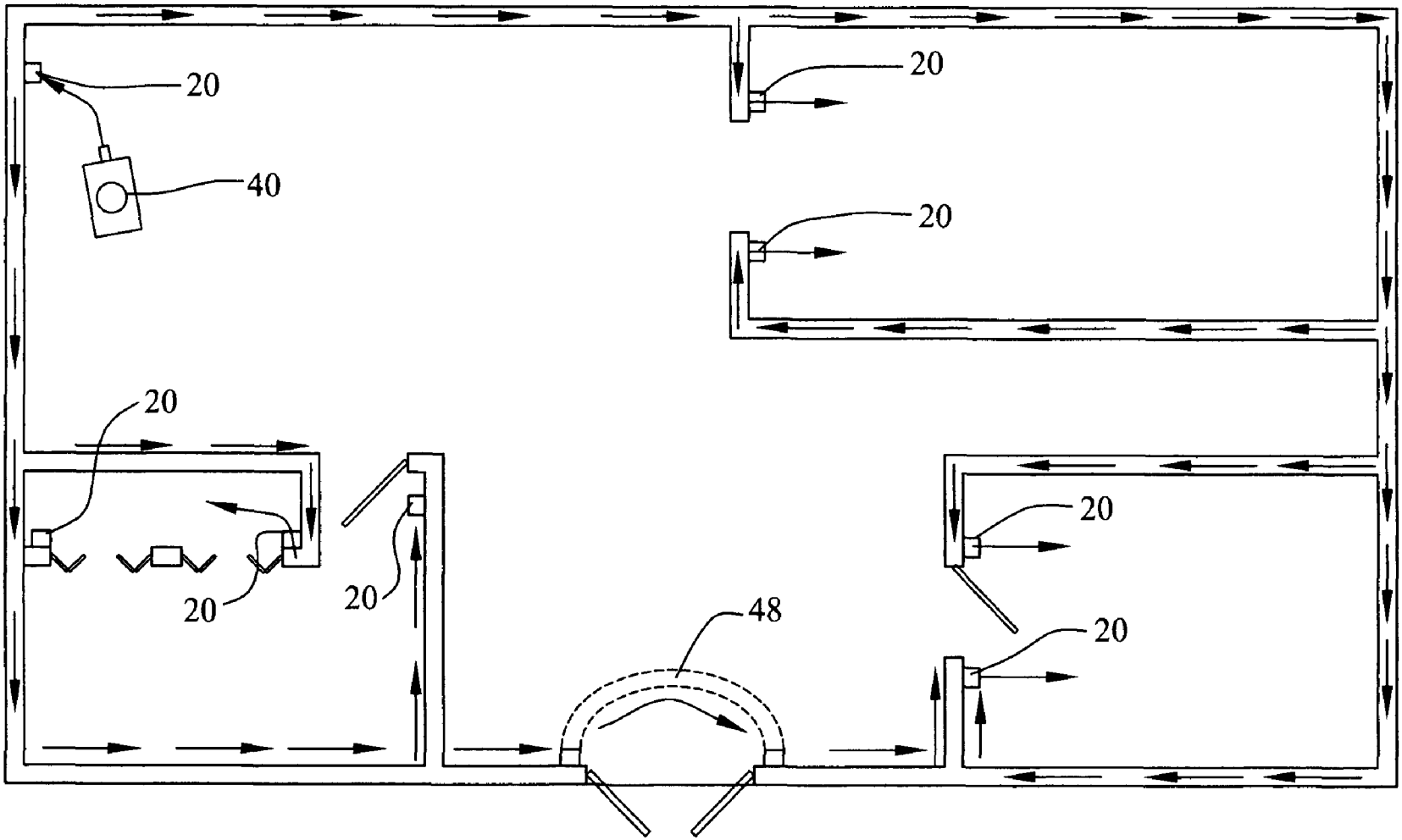
FIG. 9 is a top plan view of an interior room of a building structure showing the base dry block members of the built-in interior wall cavity drying and filtration system installed throughout the perimeter of the base of the walls, a jumper hose on the floor surface or over a doorway or window and communicating with the airflow channel of separate base dry block members, with a forced supply of dry air being pushed into the airflow channel at a connection port and being directed outwards from the interior wall cavity at separate connection ports in accordance with another preferred embodiment of the present invention.

FIG. 9 illustrates the perimeter of a building interior installed with the built-in interior wall cavity drying and filtration system 10, wherein a dry air blower 40 pushes dry air into the airflow channel 22, thereby allowing the forced dry air to circulate into the interior wall cavities in order to remove moisture and dampness at uncapped connection ports 20. As further illustrated in FIG. 9, a jumper hose 48 may be used where necessary to prevent a discontinuous airflow channel 22, such as in locations where a door (as in FIG. 9) or floor-to-ceiling windows are present.

According to several preferred embodiments of the invention, the base dry block members 12 may be fabricated of various water resistant materials such as, but not limited to, high density polyethylene, ceramic or concrete. It is further considered that certain applications of the base dry block members 12 may utilize fire resistant materials. The use of fire resistant blocks sized to fit snuggly within the airflow channel 22 provides an additional measure to prevent fire from spreading throughout the drying and filtration system 10. Base dry block members 12 may further be provided with spacer members 34 that keep the base dry block members 12 off the base of the interior wall frame structure, either wood or metal base, thereby providing an airspace gap to promote drying.

While the present invention has been shown and described in accordance with several preferred and practical embodiments thereof, it is recognized that departures from the instant disclosure are fully contemplated within the spirit and scope of the present invention.

What is claimed is:

1. An interior wall cavity drying and filtration system for installation on opposing sides of an interior wall frame structure along a wall base in between a bottom edge of a gypsum board and a floor surface, and said interior wall cavity drying and filtration system comprising:

a plurality of base dry block members having an inner facing side and an outer facing side;

a plurality of door frame dry block members having an inner facing side and an outer facing side;

an interior airflow channel within said interior wall cavity created by said inner facing side of said plurality of base dry block members and said inner facing side of said plurality of door frame dry block members, said interior airflow channel being in communication with said interior wall cavity;

a plurality of connection ports on said plurality of base dry block members and said plurality of door frame dry block members in communication with said interior airflow channel, and said plurality of connection ports being structured and disposed receiving an attachment on said outer facing side of said plurality of base dry block members and said outer facing side of said plurality of door frame dry block members; and a fastening mechanism structured and disposed for securing said plurality of base dry block members and said plurality of door frame dry block members to said interior wall frame structure.

2. The interior wall cavity drying and filtration system as recited in claim 1 wherein said attachment is a dry air blower.

3. The interior wall cavity drying and filtration system as recited in claim 1 wherein said attachment is a suction device.

4. The interior wall cavity drying and filtration system as recited in claim 1 wherein said attachment is a dehumidifier.

5. The interior wall cavity drying and filtration system as recited in claim 1 wherein said attachment is a decorative cap.

6. The interior wall cavity drying and filtration system as recited in claim 1 wherein said plurality of base dry block members and said plurality of door frame dry block members are fabricated of a water resistant material.

7. The interior wall cavity drying and filtration system as recited in claim 1 wherein said plurality of base dry block members and said plurality of door frame dry block members are fabricated of a fire resistant material.

8. The interior wall cavity drying and filtration system as recited in claim 1 wherein said plurality of base dry block members and said plurality of door frame dry block members are fabricated of a material suitable for preventing capillary action.

9. The interior wall cavity drying and filtration system as recited in claim 1 wherein said plurality of base dry block members and said plurality of door frame dry block members are fabricated of a material having high dimensional stability characteristics.

* * * * *